US007156603B2

(12) United States Patent
Marcotte

(10) Patent No.: US 7,156,603 B2
(45) Date of Patent: Jan. 2, 2007

(54) ROAD TRANSPORTABLE LOADING MACHINE FOR GONDOLA CARS

(75) Inventor: Neil Marcotte, Regina (CA)

(73) Assignee: Brandt Road Rail Corporation (CA)

( * ) Notice: Subject to any disclaimer, the term of this patent is extended or adjusted under 35 U.S.C. 154(b) by 460 days.

(21) Appl. No.: 10/611,154

(22) Filed: Jul. 1, 2003

(65) Prior Publication Data

US 2004/0037681 A1 Feb. 26, 2004

(51) Int. Cl.
*B65G 67/02* (2006.01)

(52) U.S. Cl. ..... 414/339; 414/809

(58) Field of Classification Search ..... 414/339, 414/347, 412, 543, 809; 212/315; 405/158
See application file for complete search history.

(56) References Cited

U.S. PATENT DOCUMENTS 3,642,324 A * 2/1972 Conner ..... 298/11
3,734,220 A * 5/1973 Smith ..... 180/8.6
4,099,635 A 7/1978 Leonard et al.
4,190,394 A 2/1980 Herzog et al.
4,479,750 A * 10/1984 Johnson, Jr. ..... 414/392
5,342,159 A * 8/1994 Warren et al. ..... 414/339
6,190,106 B1 2/2001 Richardson et al.
6,561,742 B1 5/2003 Crawford et al.

* cited by examiner

*Primary Examiner*—Eileen D. Lillis
*Assistant Examiner*—Charles A. Fox
(74) *Attorney, Agent, or Firm*—Greenebaum Doll & McDonald PLLC; Glenn D. Bellamy

(57) ABSTRACT

A material handling and transport apparatus for railroad use comprises a rail car loading assembly and a deck vehicle. The rail car loading assembly comprises a loading machine having a handling arm, and means to move the rail car loading assembly forward and rearward along top edges of sidewalls of a string of gondola cars and across gaps between the gondola cars. The deck vehicle comprises a deck located at a deck end of the deck vehicle such that the deck can be maneuvered adjacent to an end gondola car of the string of gondola cars wherein the deck is located at a vertical loading position such that the means to move the rail car loading assembly is operative to move the rail car loading assembly onto the deck.

20 Claims, 10 Drawing Sheets

ROAD TRANSPORTABLE LOADING MACHINE FOR GONDOLA CARS

This invention is in the field of railroad equipment and in particular material handling equipment for track maintenance and construction.

BACKGROUND

Rail bed maintenance and construction requires moving various materials such as gravel, ties and the like to work locations along the rail bed, and moving other materials such as used ties, off the rail bed. The materials are typically transported in open top rail cars called gondola cars. Where small quantities of material are involved a single gondola car, or a truck adapted for rail travel, with an attached handling arm can be utilized satisfactorily. Where larger quantities are required, it is desirable to move a string of cars, and preferably also provide a machine with a handling arm capable of unloading or loading the material as may be required.

U.S. Pat. No. 6,190,106 to Richardson et al., and U.S. Pat. No. 6,561,742 to Crawford et al. disclose loading machines with handling arms rotatable about the apparatus to load and unload as required from the front, rear or sides of the apparatus. The loading machines move along the top edges of the sidewalls of a gondola car as required. Ramps are provided to allow the loading machines to climb into position atop the sidewalls, however the machines of Richardson et al. and Crawford et al. are not able to cross from one gondola car in a string to the next.

To provide satisfactory service the loading machine should be able to travel from one car to the next to load or unload the material from a string of cars. U.S. Pat. No. 4,099,635 to Leonard et al. discloses a loading machine apparatus that has the ability to move along the top edges of the sidewalls of a gondola car, and across the gap between the gondola cars in a string such that same can be conveniently used to unload or load a string of gondola cars, however no means is disclosed for positioning the apparatus on the top of the sidewalls.

Backhoes have also been adapted to travel along the top edges of gondola car sidewalls. Such an adapted backhoe is disclosed in U.S. Pat. No. 4,190,394 to Herzog et al. The backhoe is moved into position on the top edges of the gondola car sidewalls by manipulating the boom and bucket of the backhoe. Similar manipulation moves the backhoe across the gaps between cars. To move onto the gondola car, the entire machine is raised a considerable distance off the ground to a height equal to the height of the gondola car, and balanced on the front bucket and rear boom of the backhoe. Stability of the backhoe while raising same to the top of the gondola car is thus a concern. Slot trains are also known comprising cars that have no end walls, and have a substantially continuous floor from one end of the string to the other. An excavator or like machine with a handling arm is simply driven along the floor, loading or unloading as required. Material brought in must be trans-loaded onto the slot train from a transport train that carries the material to the work site. Similarly, material picked up from the rail bed and loaded in the slot train must be trans-loaded onto a transport train to be hauled away. Considerable extra time is thus required.

Loading machines are also known that include a lengthy frame that can be extended forward and rearward with respect to the loading machine. The loading machine and frame are mounted on wheels that travel along the top of gondola car sidewalls similar to the apparatus of Leonard et al. To move from one car to the next, the frame is extended ahead of the loading machine across the gap separating the cars such that it is supported by the gondola cars on each side of the gap. Once the frame is in place on both cars, the loading machine is moved along the frame across the gap and onto the next gondola car where it can operate to load or unload that car. To maneuver the apparatus onto a second string of cars, the first string must be backed up to the second string and the apparatus moved onto the second string, the first string must be moved away, dropped, and the engine re-attached to the second string. Considerable time is thus required to move the apparatus to a fresh string of cars.

SUMMARY OF THE INVENTION

It is an object of the present invention to provide a material handling and transport apparatus for railroad use that overcomes problems in the prior art. It is a further object of the present invention to provide such an apparatus comprising a rail car loading assembly that can load, unload, and similarly handle material in each of a string of gondola cars, and a deck vehicle onto which the rail car loading assembly can be moved for transport to another string of gondola cars. It is a further object of the present invention to provide such an apparatus that can be transported on roads and highways with a maximum elevation of 13.5 feet so as to meet load limitations for public highway use in many jurisdictions.

The present invention provides in a first embodiment a material handling and transport apparatus for railroad use comprising a rail car loading assembly and a deck vehicle. The rail car loading assembly comprises a loading machine having a handling arm, and a bridge beam assembly slidably attached to the loading machine such that the bridge beam assembly can be selectively extended forward and rearward of the loading machine. The rail car loading assembly is adapted to be alternately supported on top edges of sidewalls of a gondola car by the loading machine and the bridge beam assembly such that the bridge beam assembly can be extended forward and rearward with respect to the loading machine to move the rail car loading assembly forward and rearward along top edges of sidewalls of a string of gondola cars and across gaps between the gondola cars. The deck vehicle comprises a deck located at a deck end of the deck vehicle such that the deck vehicle can be maneuvered to position the deck adjacent to an end gondola car of the string of gondola cars. The deck is located at a vertical loading position such that the bridge beam assembly can be extended onto the deck and supported on the deck to move the rail car loading assembly onto the deck.

The present invention provides in a second embodiment a material handling and transport apparatus for railroad use comprising a rail car loading assembly and a deck vehicle. The rail car loading assembly comprises a loading machine having a handling arm, and means to move the rail car loading assembly forward and rearward along top edges of sidewalls of a string of gondola cars and across gaps between the gondola cars. The deck vehicle comprises a deck located at a deck end of the deck vehicle such that the deck vehicle can be maneuvered to position the deck adjacent to an end gondola car of the string of gondola cars wherein the deck is located at a vertical loading position such that the means to move the rail car loading assembly is operative to move the rail car loading assembly onto the deck.

The present invention provides in a third embodiment a method of handling material in a plurality of strings of gondola cars. The method comprises providing an automotive rail car loading assembly comprising a loading machine having a handling arm; moving the rail car loading assembly forward and rearward along top edges of sidewalls of a first string of gondola cars and across gaps between the gondola cars and manipulating the handling arm to handle the material; providing a deck vehicle comprising a deck located at a deck end of the deck vehicle; maneuvering the deck vehicle to position the deck adjacent to a first end gondola car of the first string of gondola cars wherein the deck is located at a vertical loading position; moving the rail car loading assembly from top edges of sidewalls of the first end gondola car onto the deck; lowering the deck to a vehicle transport position; moving the deck vehicle to a position wherein the deck is adjacent to a second end gondola car of a second string of gondola cars; raising the deck to the vertical loading position; moving the rail car loading assembly onto top edges of sidewalls of the second end gondola car; and moving the rail car loading assembly forward and rearward along top edges of sidewalls of the second string of gondola cars and across gaps between the gondola cars and manipulating the handling arm to handle the material.

Conveniently the loading machine and bridge beam assembly are provided with bases and clamps to engage the sidewalls of the gondola cars. The bases are on jacks so that the bridge bases and loader bases can be moved up and down selectively such that the rail car loading assembly is alternately supported by the loader bases on the loading machine and the bridge bases on the bridge beam assembly. When the rail car loading assembly is supported on the loader bases the bridge beam assembly can be extended forward and rearward with respect to the loading machine, then the bridge bases are lowered onto the sidewall and the loader bases raised so the loading machine can then move along the bridge beam assembly. Thus the rail car loading assembly can be walked forward and rearward as required.

For travel on public roads the rail car loading assembly can be walked from the deck to a lower location on a trailer where the overall height of the rail car loading assembly can be kept below 13.5 feet for travel on public roads. Also, for increased stability, the loading machine can be mounted on lateral slides so that same may move to the side of the gondola car opposite the side toward which the loading arm is extended to handle material.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
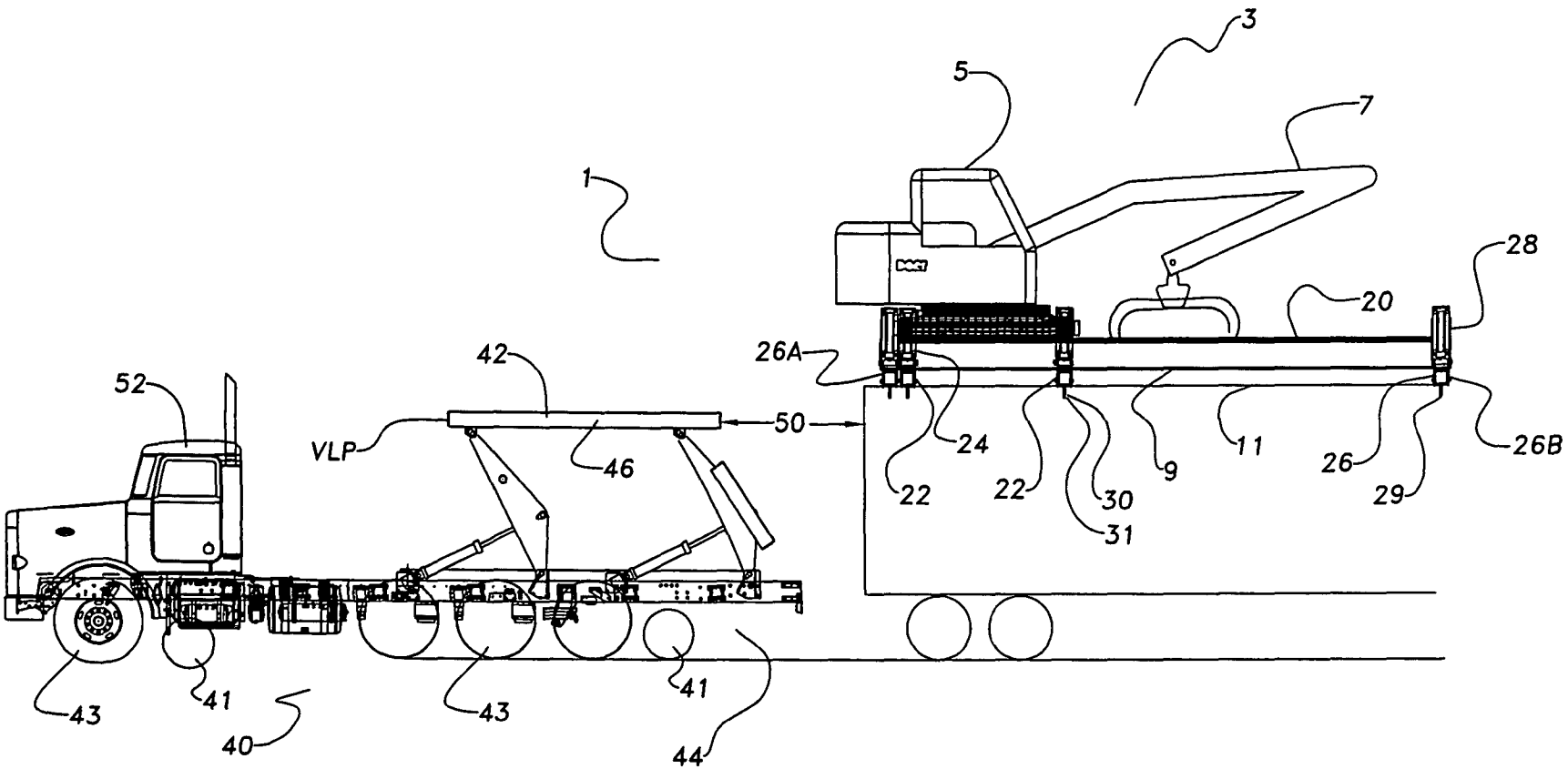
FIG. 1 is a side view of an embodiment of a material handling and transport apparatus of the invention.
Figure 2:
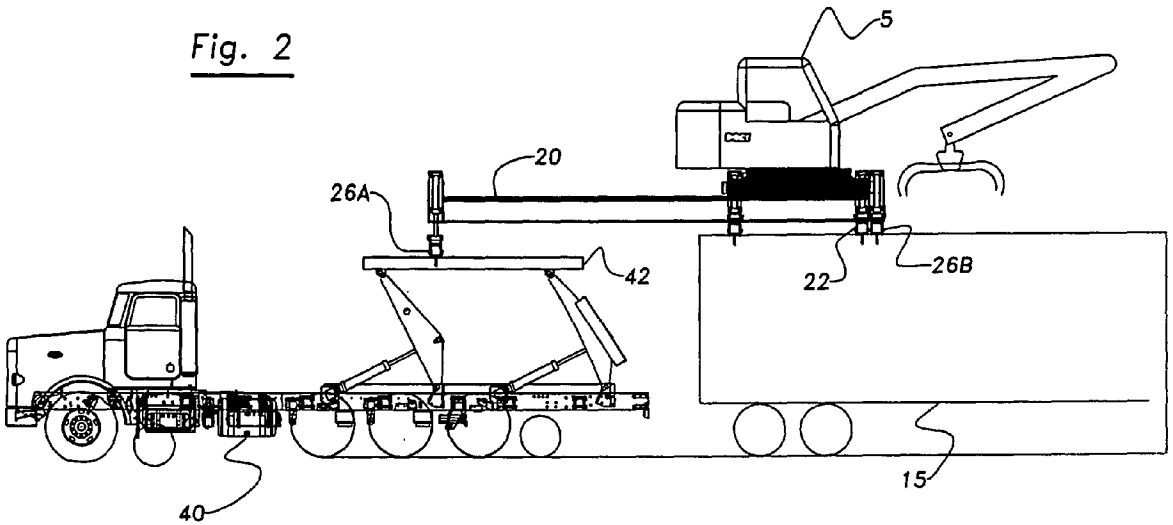
FIGS. 2–8 are side views of the embodiment of FIG. 1 showing how the rail car loading assembly is moved from the gondola car to a vehicle transport position on the deck of the deck vehicle.
Figure 3:
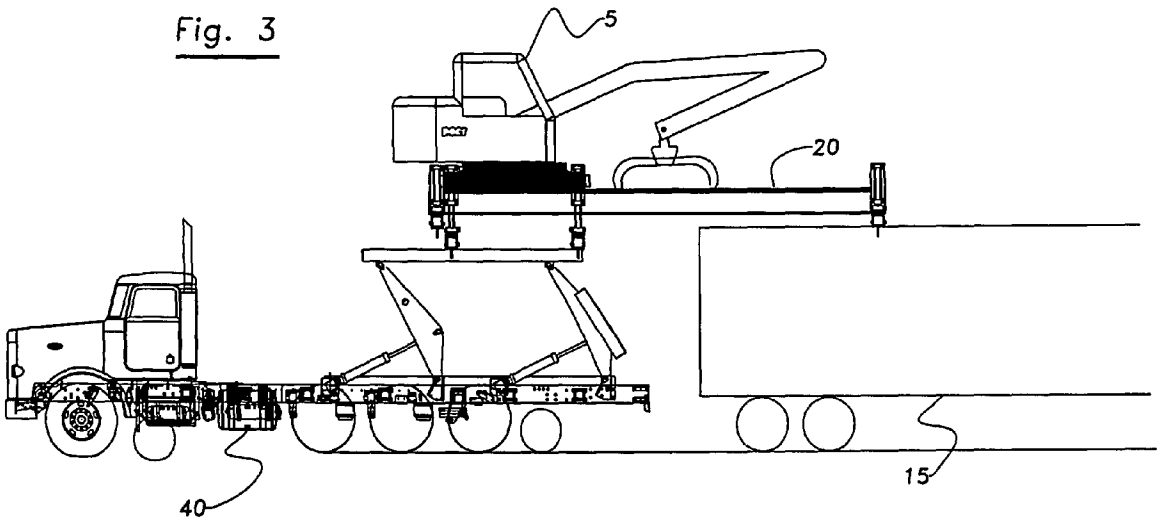
Figure 4:
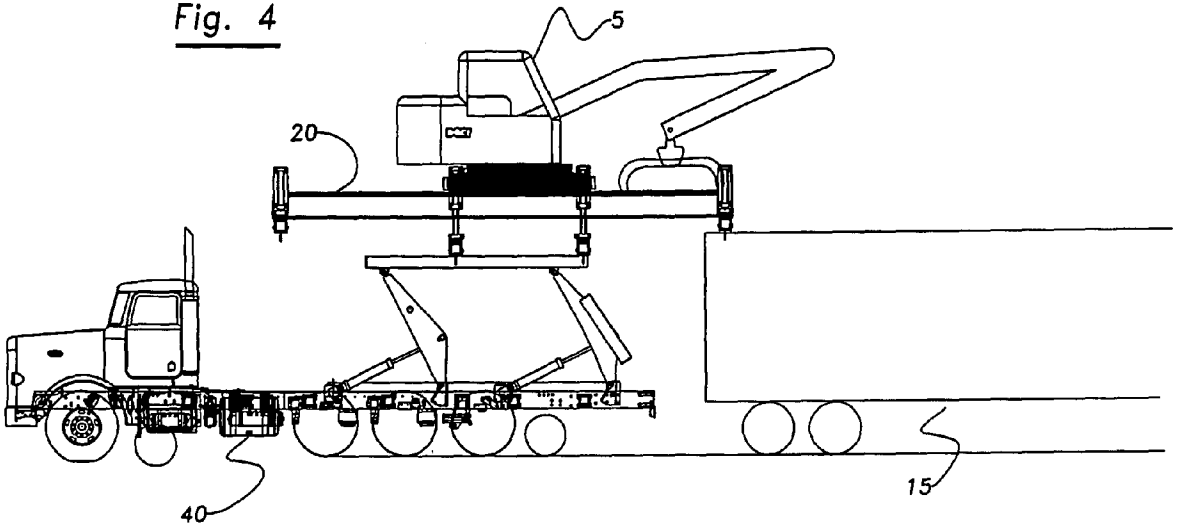

FIGS. 1–21 illustrate a material handling and transport apparatus 1 for railroad use. The apparatus 1 comprises a rail car loading assembly 3 comprising a loading machine 5 having a handling arm 7. Means 9 are provided to move the rail car loading assembly 3 forward and rearward along top edges 11 of sidewalls 13 of a string of gondola cars 15 and across gaps 17 between the gondola cars 15 as illustrated in FIGS. 17–20.

In the illustrated embodiment the means 9 to move the rail car loading assembly 3 forward and rearward along top edges 11 of sidewalls 13 comprise a bridge beam assembly 20 slidably attached to the loading machine 5 such that the bridge beam assembly 20 can be selectively extended forward and rearward of the loading machine 5. The bridge beam assembly 20 is moved back and forth with respect to the loading machine 5 by gears, hydraulic cylinders, a rack and pinion mechanism, or like system known in the art. The rail car loading assembly 3 is alternately supported on the top edges 11 of sidewalls 13 by the loading machine 5 and the bridge beam assembly 20.

The illustrated loading machine 5 further comprises loader bases 22 with clamps 30 adapted to engage the top edges 11 of the sidewalls 13 by selectively clamping to the sidewall 13. The loader bases 22 are mounted on loader jacks 24 such that the loader bases 22 are selectively movable up and down with respect to the loading machine 5. Similarly the bridge beam assembly 20 further comprises bridge bases 26 with clamps 30 adapted to engage the top edges 11 of the sidewalls 13 by selectively clamping to the sidewall 13. The bridge bases 26 are mounted on bridge jacks 28 such that the bridge bases 26 are selectively movable up and down with respect to the bridge beam assembly 20. Front bridge bases 26A are located forward of the loading machine 5 and rear bridge bases 26B are located rearward of the loading machine 5.

Figure 21:
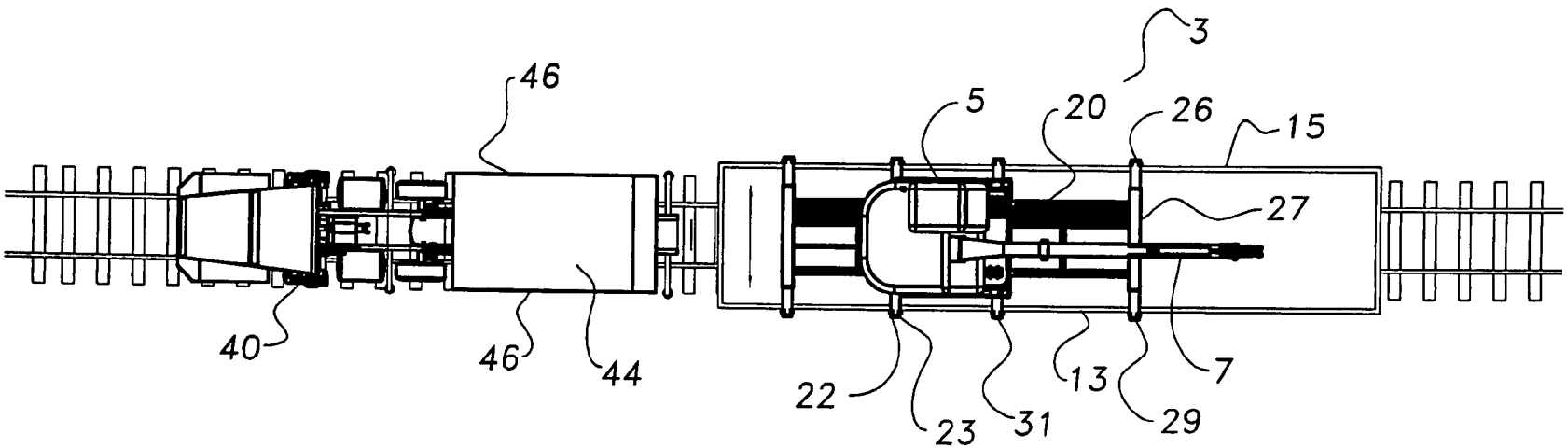
FIG. 21 is a top view of the embodiment of FIG. 1 with the rail car loading assembly on top of a gondola car.

In the illustrated embodiment, as seen in FIG. 21, the loader bases 22 comprise a loader member 23 that extends across an open top of the gondola car 15 with flanges 31 extending down from the top edges 11 of the sidewalls 13 along the outside of the sidewalls 13. The flanges 31 are operative to selectively bear against the outside of the sidewalls 13 to clamp the loader bases 22 to the sidewalls 13. Similarly the bridge base 26 comprise a bridge member 27 that extends across an open top of the gondola car with bridge flanges 29 extending down from the top edges 11 of the sidewalls 13 along the outside of the sidewalls 13. The bridge flanges 29 are operative to selectively bear against the outside of the sidewalls 13 to clamp the bridge bases 26 to the sidewalls 13.

In the illustrated embodiment the loader and bridge members 23, 27 are extendable and retractable such that retracting the member brings the flanges 29, 31 to bear against the outside of the sidewalls 13. Alternately, the flanges 29, 31 could pivot on the ends of the members 23, 27 and be moved against and away from the sidewalls 13 with a hydraulic cylinder or the like to clamp the members 23, 27 to the sidewalls 13. Similarly an alternate clamp 30 might comprise a mechanism which squeezes both sides of each sidewall 13, much a it would be grasped with a hand. Other clamps such as are known in the art are contemplated as well.

With the loader bases 22 down and the bridge bases 26 up, the rail car loading assembly 3 is supported on the loader bases 22 and bridge bases 26 are clear and bearing no weight so the bridge beam assembly 20 can be extended forward or rearward with respect to the loading machine 5. Once extended the bridge bases 26 are moved down and clamped and the loader bases 22 are moved up so that the rail car loading assembly 3 is supported on the bridge bases 26 and the loader can then move back and forth on the bridge beam assembly 20. In this way the rail car loading assembly 3 can be walked along the gondola car 15, and across a gap 17 to the next gondola car 15 in a string as illustrated in FIGS. 17–20.

For maximum stability, once the loading machine 5 is located in a desired location for working, the clamps 30 on the loader bases 22 and bridge bases 26 are all engaged to clamp the sidewall 13. The loading machine 5 and handling arm 7 are rotatably mounted with respect to the rail car loading assembly 3 such that the handling arm 7 can extend and operate in substantially any direction. All of the clamps 30 hold the rail car loading assembly 3 stable during operations.

The apparatus 1 further comprises a deck vehicle 40 having a deck 42 located at a deck end 44 thereof such that the deck vehicle 40 can be maneuvered to position the deck 42 adjacent to an end gondola car 15A of the string of gondola cars 15. Conveniently to maintain the relative positions of the deck 42 and end gondola car 15A, the deck vehicle 40 is coupled to the end gondola car 15A. As shown in FIG. 1 the deck 42 is located at a vertical loading position VLP such that the means 9 to move the rail car loading assembly 3 is also operative to move the rail car loading assembly 3 onto the deck 42.

The illustrated deck 42 comprises a pair of side members 46 that are configured substantially the same as the top edge 11 of the sidewall 13 of the gondola car 15, as best seen in the top view of FIG. 21. In this way, the loader bases 22 and bridge bases 26 engage the deck 42 by clamping onto side members 46 in the same manner as they clamp onto the top edges 11 of the sidewalls 13 of the gondola car 15.

As illustrated in FIGS. 1–5 the rail car loading assembly 3 is walked across the gap 50 between the deck 42 and the end gondola car 15A in the same manner as it walks across the gap 17 between gondola cars 15 in a string. Thus the means 9 to move the rail car loading assembly 3 forward and rearward along top edges 11 of sidewalls 13 is also operative to move the rail car loading assembly 3 onto the deck 42.

Figure 5:
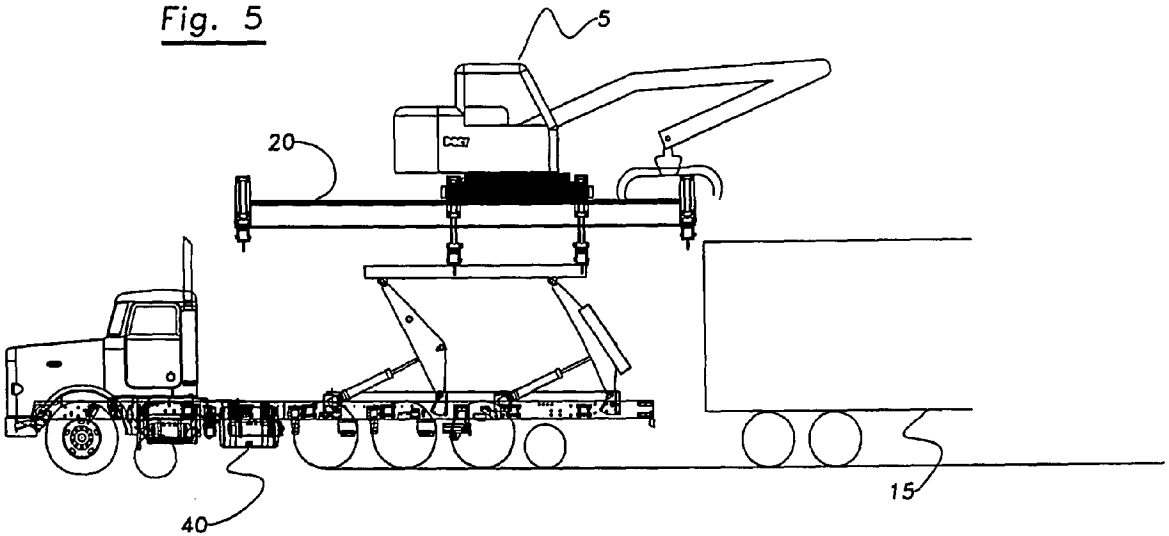
Figure 6:
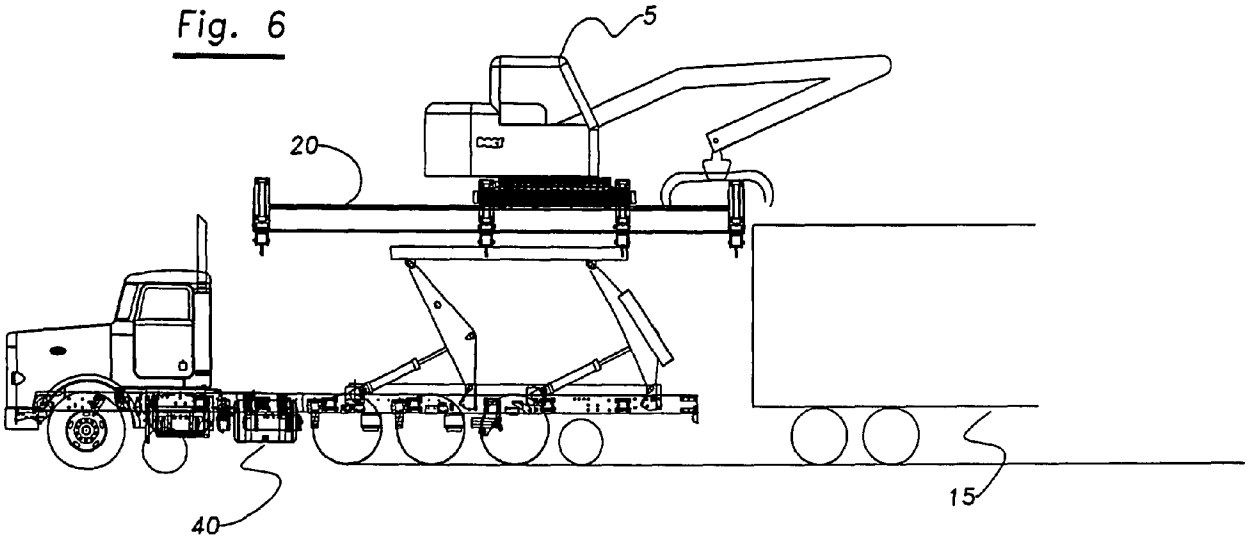
Figure 7:
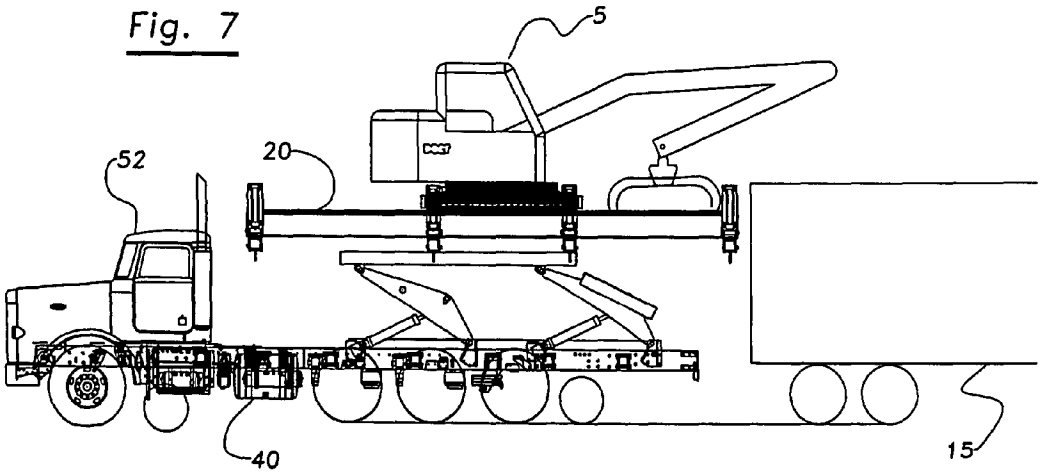

Once the rail car loading assembly 3 is supported solely by the loader bases 22 on the deck 42, as illustrated in FIG. 5, the loader bases 22 are moved up, lowering the rail car loading assembly 3 as seen in FIG. 6. Actuators 48 are then used to lower the deck 42 and rail car loading assembly 3. As the deck 42 moves down as illustrated in FIG. 7, the bridge beam assembly 20 can be manipulated back and forth as required to clear the vehicle cab 52 and end gondola car 15A. The actuators lower the deck 42 and rail car loading assembly 3 into the vehicle transport position VTP of FIG. 8.

The illustrated embodiment shows the vertical loading position VLP of the deck 42, as seen in FIG. 1, as being in proximity to a vertical location of the top edges 11 of sidewalls 13 of the end gondola car 15A. Alternatively it is contemplated that the deck 42 could be somewhat lower and the jacks 24, 28 longer however by raising the deck 42 up near the top of the end gondola car 15A, improved stability is realized.

Other rail car loading assemblies are known in the art that are operative to move back and forth along a string of rail cars such as that disclosed in U.S. Pat. No. 4,099,635 to Leonard et al, as described above. It is contemplated that such other assemblies could provide the means 9 to move the rail car loading assembly 3 forward and rearward along top edges 11 of sidewalls 13 and also be operative to move the rail car loading assembly 3 onto the deck 42.

The rail car loading assembly 3 may be moved to a new string of gondola cars 15 in the vehicle transport position VTP on the deck 42 of the deck vehicle 40. Typically however the rail car loading assembly 3 will still be too high to travel unrestricted on public roads. FIGS. 9–16 illustrate the transfer of the rail car loading assembly 3 from the deck 42 of the deck vehicle 40 to a second vehicle illustrated as a trailer 60. The means 9 to move the rail car loading assembly 3 is also operative to move the rail car loading assembly 3 from the vehicle transport position VTP on the deck 42 to a lowered trailer transport position TTP on the trailer 60 that is lower than the vehicle transport position VTP. In the trailer transport position TTP a top 62 of the rail car loading assembly 3 is less than 13.5 feet above the ground, allowing travel without special permits on public roads in many jurisdictions. The trailer 60 can be attached to any road vehicle for convenient and quick travel on public roads to any other location where it might be required. In the illustrated embodiment the deck vehicle 40 is a road rail vehicle having wheels 41 suitable for travel on rails, and wheels 43 suitable for travel on roads, and mechanisms to raise and lower the wheels 41, 43 as required for a desired mode of travel.

In the illustrated embodiment the trailer 60 is attached to the deck end 44 of the deck vehicle 40. The means 9 to move the rail car loading assembly 3 comprises the bridge beam assembly 20 and the trailer bed 64 is configured such that the bridge beam assembly 20 can be extended onto the trailer bed 64 to walk the rail car loading assembly 3 from the deck 42 onto the trailer bed 64 and into a trailer transport position TTP that is lower than the vehicle transport position VTP.

The trailer bed 64 comprises three higher posts 65, four intermediate posts 66, and four lower posts 67 on each side of the trailer bed 64. The bridge beam assembly 20 is manipulated over the trailer bed 64 and the higher, intermediate, and lower posts 65, 66, 67 are selectively engaged by clamps 30 on the loader bases 22 and bridge bases 26 as the bridge beam assembly 20 and loading machine 5 are manipulated to walk the rail car loading assembly 3 onto the trailer bed 64 and lower the rail car loading assembly 3 into the trailer transport position TTP as illustrated in FIGS. 9–16.

The invention thus provides a method of handling material in a plurality of strings of gondola cars. An automotive rail car loading assembly 3 comprising a loading machine 5 having a handling arm 7 moves forward and rearward along top edges 11 of sidewalls 13 of a first string of gondola cars 15 and across gaps 17 between the gondola cars 15 and the handling arm 7 is manipulated as desired to handle the material. The rail car loading assembly 3 is automotive or self-propelled, powered by the engine of the loading machine 5.

For the most secure operation, once the loading machine 5 is in the desired work location, clamps 30 on both the loader and bridge bases 22, 26 are used to clamp the bases to the sidewalls 13 of the gondola car 15.

A deck vehicle 40 comprises a deck 42 located at a deck end 44 of the deck vehicle 40. The deck vehicle 40 is maneuvered to position the deck 42 adjacent to a first end gondola car 15A of the first string of gondola cars 15. The deck 42 is located at a vertical loading position and the rail car loading assembly 3 moves from top edges 11 of sidewalls 13 of the first end gondola car 15A onto the deck 42 by manipulating the bridge beam assembly 20 and loading machine 5 in a walking action as illustrated in FIGS. 1–5.

Figure 8:
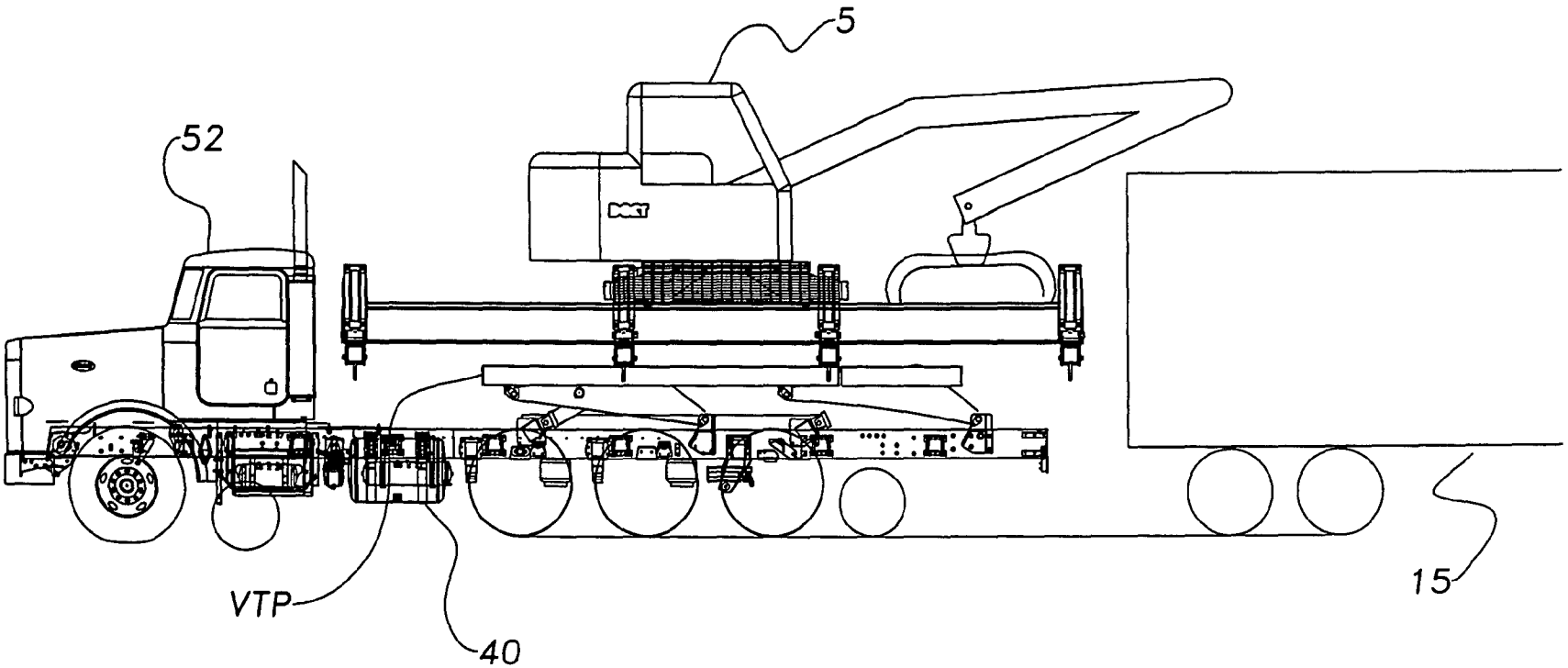
Figure 9:
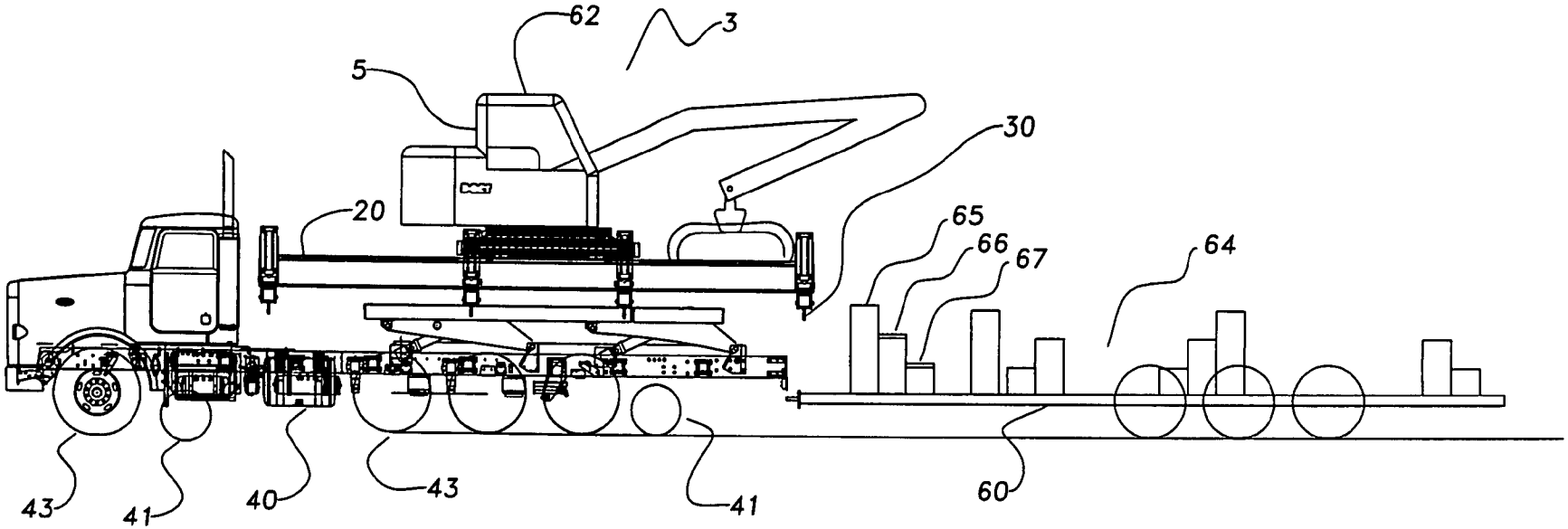
FIGS. 9–16 are side views of the embodiment of FIG. 1 showing how the rail car loading assembly is moved from the vehicle transport position on the deck of the deck vehicle to a lower trailer transport position on a trailer bed.
Figure 10:
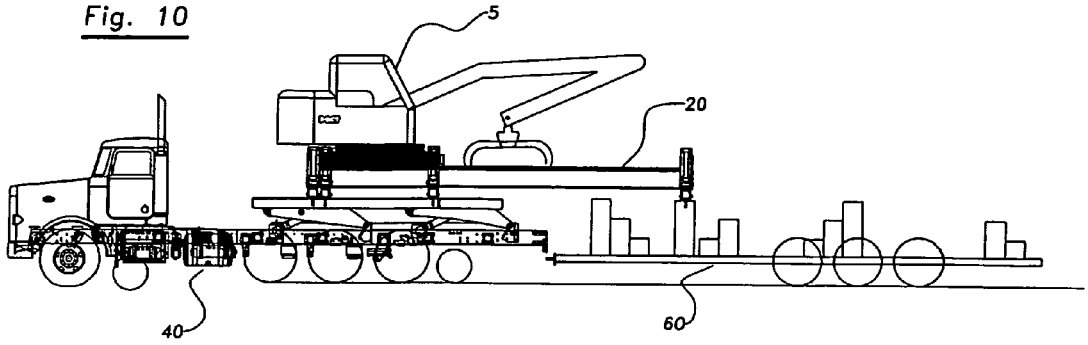
Figure 11:
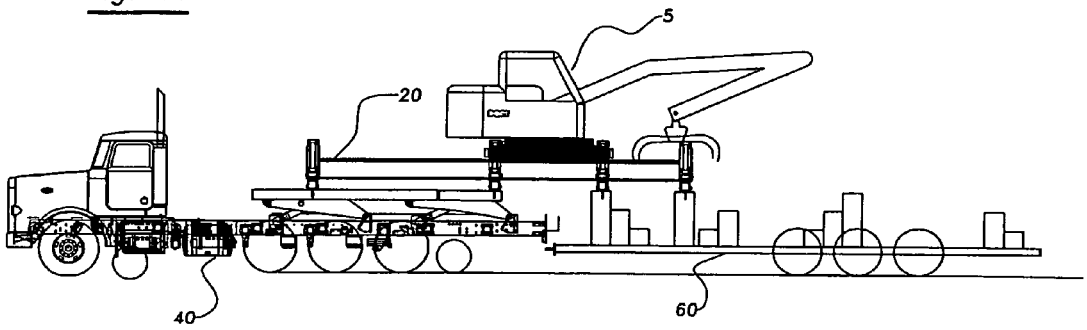
Figure 12:
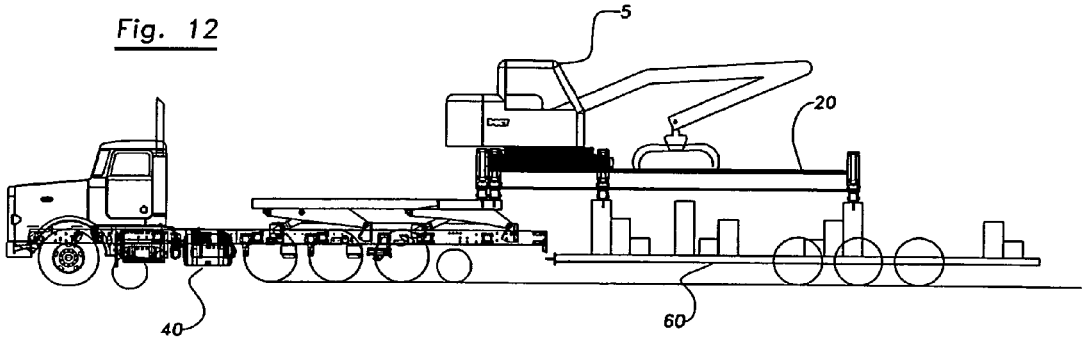
Figure 13:
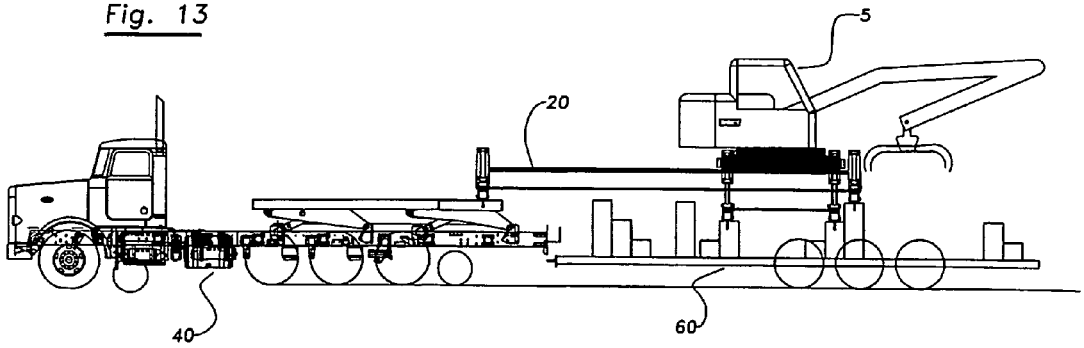
Figure 14:
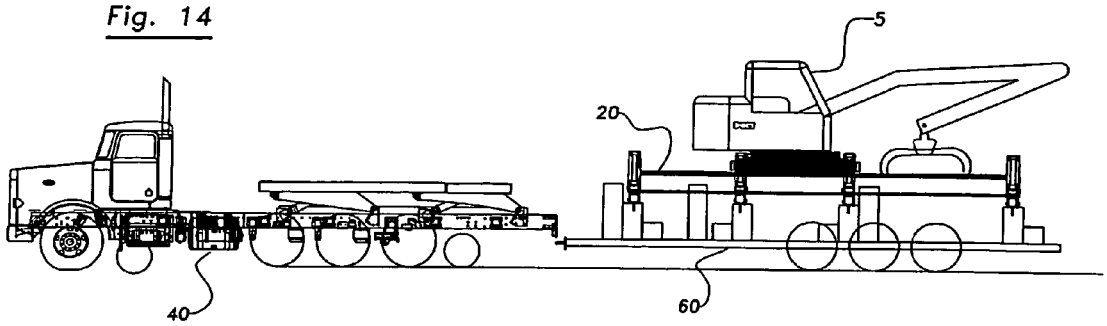
Figure 15:
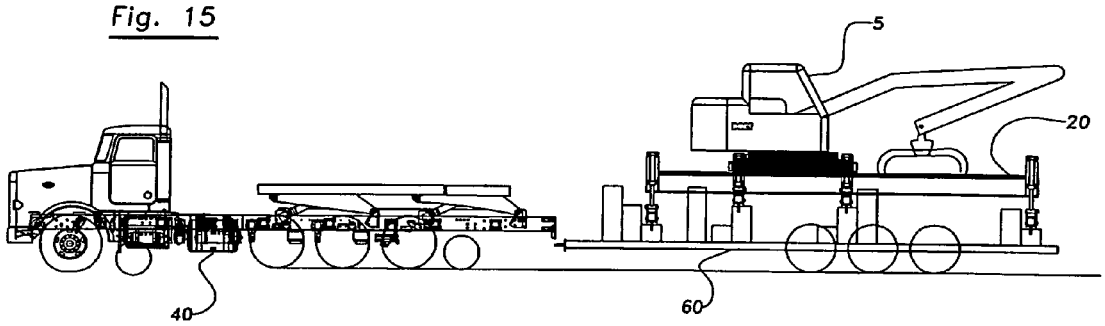
Figure 16:
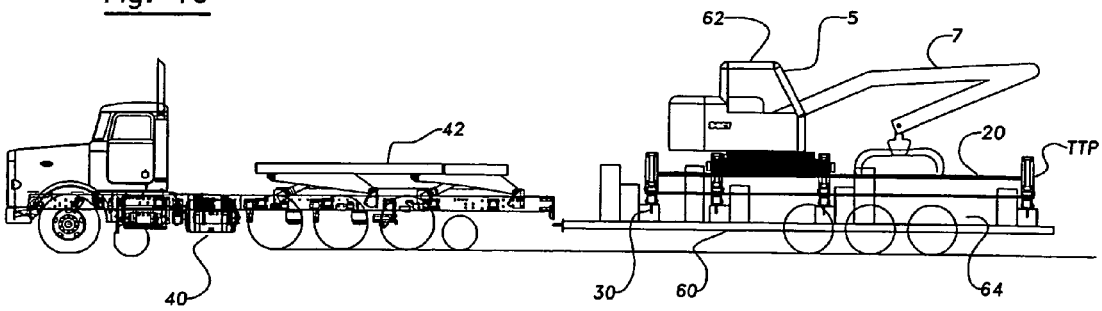
Figure 17:
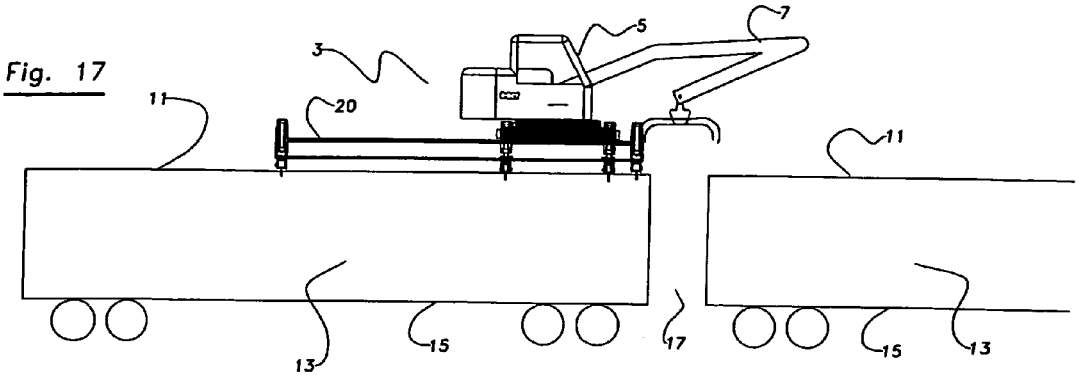
FIGS. 17–20 are side views of the embodiment of FIG. 1 showing how the rail car loading assembly is moved from one gondola car to the next in a string of gondola cars.
Figure 18:
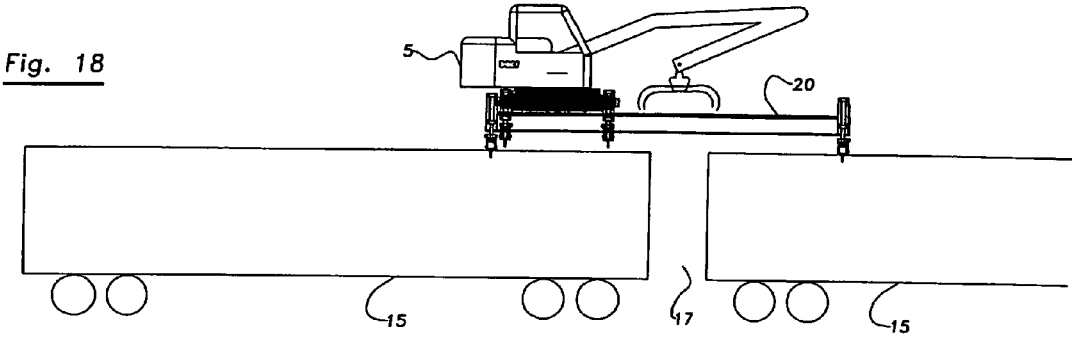
Figure 19:
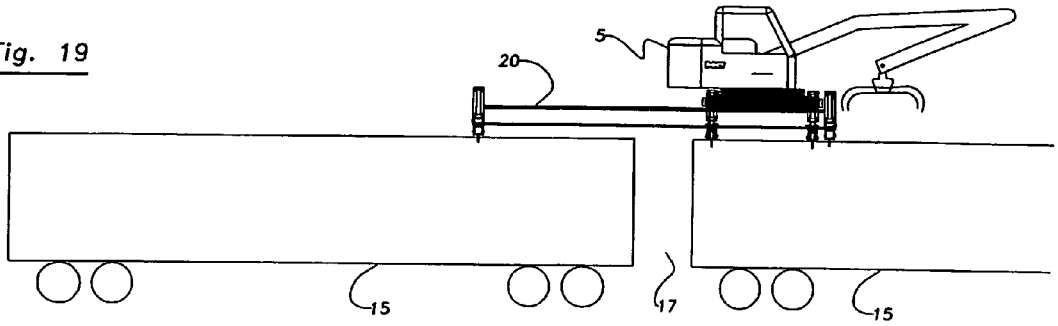
Figure 20:
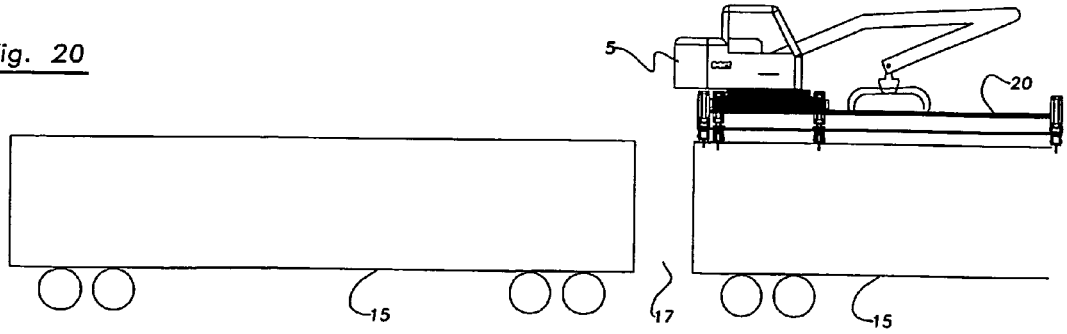

The deck 42 and rail car loading assembly 3 are then lowered to the vehicle transport position VTP of FIG. 8. In some cases the deck vehicle 40 can then simply be moved to the end gondola car of a second string of gondola cars and the process reversed to position the rail car loading assembly 3 on the second string of gondola cars, however typically the apparatus 1 will be too high for unrestricted travel on public roads. In that case a the rail car loading assembly 3 is moved from the vehicle transport position VTP on the deck 42 to a second vehicle, such as a trailer 60, in the lower trailer transport position TTP illustrated in FIG. 16.

Again the bridge beam assembly 20 and loading machine 5 are manipulated to walk the rail car loading assembly 3 from the deck 42 to the trailer bed 64, this time by clamping to the posts 65, 66, 67 as illustrated in FIGS. 9–16. The rail car loading assembly 3 can be configured so that the top 62 of the rail car loading assembly 3 is less than 13.5 feet above the ground.

The trailer 60 is then moved along a road to a location in proximity to a second string of gondola cars, and the process reversed to walk the rail car loading assembly 3 from the trailer transport position TTP on the trailer 60 to the vehicle transport position VTP on the deck 42 of the deck vehicle 40. Then the deck 42 and rail car loading assembly 3 are moved into a position adjacent to the end gondola car of a second string of gondola cars and walked onto the top edges 11 of the sidewalls 13 thereof to handle the material for the second string.

Thus the invention provides a versatile method and apparatus for unloading separate and widely separated strings of gondola cars. The handling arm can be configured with a grapple for handling ties, a bucket for granular material such as gravel, or other mechanism such as might be suitable for handling a particular material while maintaining stability of the apparatus.

FIG. 21 also illustrates wherein the rail car loading assembly 3 comprises lateral slides operative to shift the loading machine 5 toward either side of a gondola car. In the illustrated embodiment the extendable and retractable loader and bridge members 23, 27 can be manipulated to shift the loading machine 5 toward a side of the gondola car 15 opposite that side on which the loading arm 7 is extended to handle material. Stability is thus improved.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A material handling and transport apparatus for railroad use comprising:

a rail car loading assembly comprising:

a loading machine having a handling arm;

a bridge beam assembly slidably attached to the loading machine such that the bridge beam assembly can be selectively extended forward and rearward of the loading machine;

wherein the rail car loading assembly is adapted to be alternately supported on top edges of sidewalls of a gondola car by the loading machine and the bridge beam assembly such that the bridge beam assembly can be extended forward and rearward with respect to the loading machine to move the rail car loading assembly forward and rearward along top edges of sidewalls of a string of gondola cars and across gaps between the gondola cars;

a deck vehicle comprising:

a deck located at a deck end of the deck vehicle such that the deck vehicle can be maneuvered to position the deck adjacent to an end gondola car of the string of gondola cars;

wherein the deck is located at a vertical loading position such that the bridge beam assembly can be extended onto the deck and supported on the deck to move the rail car loading assembly onto the deck and wherein the deck and rail car loading assembly can be lowered to a vehicle transport position;

a trailer adapted for attachment to the deck end of the deck vehicle, the trailer comprising a trailer bed configured such that the bridge beam assembly can be extended onto the trailer bed to move the rail car loading assembly from the deck onto the trailer bed and into a trailer transport position that is lower than the vehicle transport position.

2. The apparatus of claim 1 wherein the deck end of the deck vehicle is adapted for attachment to the end gondola car.

3. The apparatus of claim 1 wherein the vertical loading position is in proximity to a vertical location of the top edges of sidewalls of the end gondola car.

4. The apparatus of claim 1 further comprising actuators operative to lower the rail car loading assembly to the vehicle transport position.

5. The apparatus of claim 1 wherein the deck vehicle is adapted for travel on rails or on the ground.

6. The apparatus of claim 1 wherein the trailer is further adapted for attachment to a road vehicle for transport along a road and wherein a top of the rail car loading assembly is less than 13.5 feet above the ground when the rail car loading assembly is in the trailer transport position.

7. The apparatus of claim 6 wherein the road vehicle is the deck vehicle.

8. The apparatus of claim 1 wherein the loading machine further comprises loader bases adapted to engage the top edges of a gondola car's sidewalls and the deck of the deck vehicle, the loader bases selectively movable up and down with respect to the loading machine;

wherein the bridge beam assembly further comprises bridge bases adapted to engage the top edges of a gondola car's sidewalls and the deck of the deck vehicle, the bridge bases selectively movable up and down with respect to the bridge beam assembly;

and wherein a front bridge base is located forward of the loading machine and a rear bridge base is located rearward of the loading machine.

9. The apparatus of claim 8 wherein the loader bases and bridge bases further comprise clamps operative to selectively clamp the loader bases and bridge bases to the sidewalls and deck.

10. The apparatus of claim 8 wherein at least one loader base comprises a loader member that extends across an open top of the gondola car with loader flanges extending down from the top edges of the sidewalls outside the sidewalls, and wherein the loader flanges are operative to selectively bear against the outside of the sidewalls to clamp the at least one loader base to the sidewalls; and wherein at least one bridge base comprises a bridge member that extends across an open top of the gondola car with bridge flanges extending down from the top edges of the sidewalls outside the sidewalls, and wherein the bridge flanges are operative to selectively bear against the outside of the sidewalls to clamp the at least one bridge base to the sidewalls.

11. The apparatus of claim 10 wherein the at least one loader member is extendable and retractable such that retracting the loader member brings the loader flanges to bear against the outside of the sidewalls.

12. The apparatus of claim 10 wherein the at least one bridge member is extendable and retractable such that retracting the bridge member brings the bridge flanges to bear against the outside of the sidewalls.

13. The apparatus of claim 1 wherein the trailer bed comprises a plurality of higher posts and a plurality of lower posts and wherein the higher and lower posts are selectively engaged by the loader bases and bridge bases to lower the rail car loading assembly into the trailer transport position.

14. The apparatus of claim 13 wherein the loader bases and bridge bases further comprise clamps operative to selectively clamp the loader bases and bridge bases to the posts.

15. The apparatus of claim 1 wherein the handling arm is rotatably mounted with respect to the rail car loading assembly such that same can extend and operate in substantially any direction.

16. The apparatus of claim 1 wherein the rail car loading assembly comprises lateral slides operative to shift the loading machine toward either side of a gondola car.

17. A method of handling material in a plurality of strings of gondola cars, the method comprising:

providing an automotive rail car loading assembly comprising a loading machine having a handling arm;

moving the rail car loading assembly forward and rearward along top edges of sidewalls of a first string of gondola cars and across gaps between the gondola cars and manipulating the handling arm to handle the material;

providing a deck vehicle comprising a deck located at a deck end of the deck vehicle;

maneuvering the deck vehicle to position the deck adjacent to a first end gondola car of the first string of gondola cars wherein the deck is located at a vertical loading position;

moving the rail car loading assembly from top edges of sidewalls of the first end gondola car onto the deck;

lowering the deck to a vehicle transport position;

providing a second vehicle and positioning the second vehicle adjacent to the deck end of the deck vehicle;

moving the rail car loading assembly from the vehicle transport position on the deck to a lowered transport position on the second vehicle that is lower than the vehicle transport position;

moving the second vehicle along a road to a location in proximity to a second string of gondola cars;

moving the rail car loading assembly from the lowered transport position on the second vehicle to the vehicle transport position on the deck of the deck vehicle;

moving the deck vehicle to a position wherein the deck is adjacent to a second end gondola car of a second string of gondola cars;

raising the deck to the vertical loading position;

moving the rail car loading assembly onto top edges of sidewalls of the second end gondola car; and moving the rail car loading assembly forward and rearward along top edges of sidewalls of the second string of gondola cars and across gaps between the gondola cars and manipulating the handling arm to handle the material.

18. The method of claim 17 wherein in the lowered transport position a top of the rail car loading assembly is less than 13.5 feet above the ground.

19. The method of claim 17 further comprising clamping the rail car loading assembly to the sidewalls of a gondola car prior to manipulating the handling arm to handle the material.

20. The method of claim 17 further comprising clamping the rail car loading assembly to the sidewalls of a gondola car, and moving the loading machine toward a first side of the gondola car and extending the loading arm toward an opposite second side of the gondola car to handle material on the opposite second side of the gondola car.

* * * * *